US005139208A

United States Patent [19]

Schooley

[11] Patent Number: 5,139,208

[45] Date of Patent: Aug. 18, 1992

[54] STORAGE RACK FOR FLEXIBLE CORD

[76] Inventor: Tracy H. Schooley, 4501 F-41 Apt. 15, Oscoda, Mich. 48750

[21] Appl. No.: 691,483

[22] Filed: Apr. 25, 1991

[51] Int. Cl.[5] ..... B65H 75/00

[52] U.S. Cl. ..... 242/85.1; 211/13; 211/194

[58] Field of Search ..... 211/13, 194, 88, 188; 242/222, 96, 100, 118.4, 125.1, 85.1, 86; 248/89, 90, 75, 51-52; 206/509, 512, 49, 388, 63.3

[56] References Cited

U.S. PATENT DOCUMENTS

| | | | |
|---|---|---|---|
| 453,119 | 5/1891 | Kelcher | 242/86 X |
| 1,035,825 | 8/1912 | Hesser | 242/85.1 |
| 2,287,368 | 6/1942 | Anderson | 242/85.1 |
| 2,366,755 | 1/1945 | Rogne | 242/96 |
| 2,533,341 | 12/1950 | Alfano | 242/85.1 |
| 3,626,495 | 12/1971 | Bastian, Jr. | 242/85.1 |
| 4,123,012 | 10/1978 | Hough | 242/85.1 |
| 4,258,843 | 3/1981 | Wymer | 206/63.3 |
| 4,261,529 | 8/1981 | Sandberg et al. | 242/85.1 |
| 4,278,212 | 7/1981 | Wesley | 242/54 R |
| 4,437,618 | 3/1984 | Boyle | 242/118.4 X |
| 4,778,125 | 10/1988 | Hu | 242/85.1 |
| 4,971,200 | 11/1990 | Huang et al. | 206/509 X |
| 5,048,702 | 9/1991 | Maloney | 211/194 |
| 5,064,067 | 11/1991 | McAllister et al. | 242/85.1 X |

FOREIGN PATENT DOCUMENTS

| | | | |
|---|---|---|---|
| 788379 | 10/1935 | France | 242/85.1 |
| 2157263 | 10/1985 | United Kingdom | 242/85.1 |

*Primary Examiner*—Karen J. Chotkowski
*Attorney, Agent, or Firm*—Keith S. Bergman

[57] ABSTRACT

A rack for storing flexible cords provides two spaced elongate sides interconnected inwardly adjacent each end by similar ends, each end defining a plurality of spaced grooves to positionally maintain coils of cord. A medial cross support communicates between the medial portions of the sides between the ends to prevent excessive sag of cord carried on the holder. Keyhole type grooves are defined in the rack to receive and releasably maintain end portions of cord stored on the rack. The side elements define cooperating sets of nubbins and indentations to align and positionally maintain a plurality of racks in stacked array. The rack is particularly adapted to formation from moldable plastic material.

1 Claim, 2 Drawing Sheets

FIG. 1
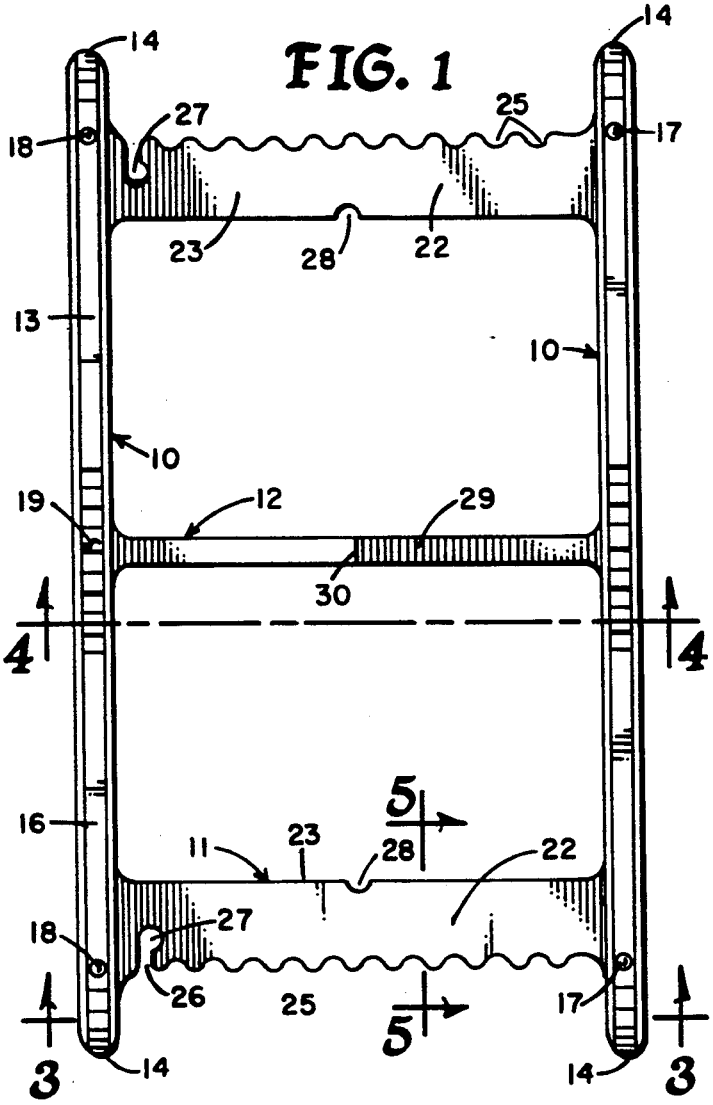
FIG. 2
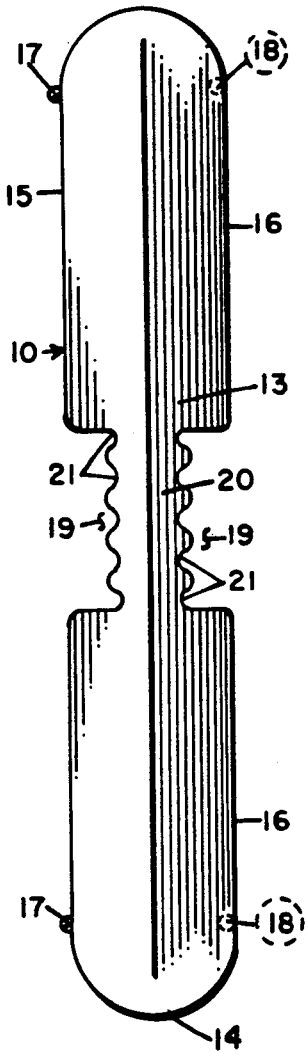
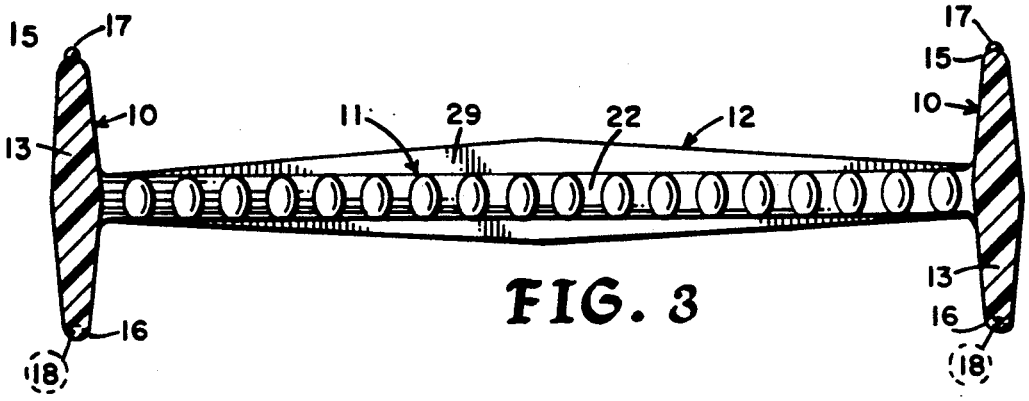
FIG. 3

STORAGE RACK FOR FLEXIBLE CORD

BACKGROUND OF INVENTION

RELATED APPLICATIONS

There are no applications related hereto heretofore filed by the instant inventor in this or any foreign country.

FIELD OF INVENTION

My invention relates generally to stackable elongate flat racks for storage of flexible cords, especially such cords as are of a complex nature.

BACKGROUND AND DESCRIPTION OF PRIOR ART

Racks of various types have long been known for the storage of elongate flexible cord-like elements. It seems, however, that the sophistication of such devices has not been nearly so great as their historicity and use, but rather has lagged to the point where modern day racks are not fulfilling their purpose to the best and highest degree possible. The instant invention seeks to provide an improved rack for flexible cords that does fulfill this potentiality.

Known racks for storage of elongate flexible cords have generally provided some type of a three-dimensional structure of a reel-like nature to allow wrapping of a cord about the rack periphery for positional maintenance. In general such structures have taken the form of either a cylindrical reel having cross-sectional diameters somewhat of equal length or a flat rack having one cross-sectional dimension substantially longer than a somewhat perpendicular cross-sectional dimension. The cylindrical type structure commonly has been used for storage of cord-like elements of substantial length and simple uniform cross-sectional configuration such as rolls of rope, cord, wire and the like. A flat rack structure has been used more commonly for shorter elements, and especially such elements that have more complex configurations, portions of which can readily become entangled during the storage process, such as yarn, fish lines with droppers, light strings and the like. The flat-type rack offers added advantages in that it generally occupies less volume than the cylindrical rack that holds a similar amount of material and a plurality of flat-type racks may generally be stored in a more compact array than a plurality of cylindrical type racks. My storage rack provides an improved rack of the flat type that has interconnecting means to aid the positional maintenance of a stacked array of associated racks.

When cords of a complex nature, such as those having droppers or other interconnected parts that extend away from the main cord body are stored, entanglement, especially during the establishment of or removal from a storage mode, remains an ever present problem. Generally this problem is alleviated by maintaining the stored cord in a single layer and physically separating each wrapped coil of cord from adjacent coils during positioning by some means that aids the positional maintenance of a stored cord in this configuration. My rack provides structure embodying these principles by creating a plurality of opposed cooperating notches in each of two similar end structures wherein a flexible cord is supported and positionally maintained. Such end elements also provide the secondary and additional function of allowing definition of keyhole type slots to hold the end portions of a cord to aid the positional maintenance of the entire cord in stored mode.

In general, it is more convenient and less expensive to define only part of a supportative surface of a storage rack, rather than an entire peripheral surface somewhat in the nature of a framework. This type of structure, however, creates added disadvantages, especially in the case of flat storage racks, because often the medial portion of stored cords or ancillary structure attached to the cords have a high potentiality for entanglement. This potentiality for entanglement is enhanced in the medial portions of such racks where portions of cords there maintained may have greater motion by reason of sag or otherwise, and the potentiality of entanglement is still further enhanced when such flat racks are stored in stacked vertical array with layers of cord coils in vertical relationship to each other. My invention lessens this problem by providing a medial cross piece carried between the end elements over which a cord is wound. This medial cross piece has substantial vertical thickness, and may have more thickness in its medial than in its end parts, to aid separation of the layers of cord coils thereabove from those therebelow.

A cord generally may be placed on a storage rack by winding about the rack or by rotating the rack to accomplish the same purpose. My storage rack provides side elements of substantial width to properly maintain stored cords thereon and allow stacking of a plurality of holders in appropriately spaced relationship to eliminate entanglement. A medial portion of each side element defines paired opposed indentations to define a smaller handle-like portion therebetween to aid the manual manipulation of the rack during cord placement and removal, whether such function be accomplished by moving the cord, the rack or both.

My cord rack provides these functions in a unified structure that may be formed by molding from polymeric or resinous plastics in a two piece mold of relatively simple and economic nature.

The invention in my storage rack lies not in any one of these features per se, but rather in the synergistic combination of all of its structures to provide the functions necessarily flowing therefrom as herein specified and claimed.

SUMMARY OF INVENTION

My cord storage rack generally provides two similar elongate sides interconnected in spaced parallel relationship by two similar ends extending therebetween. A cross support extends between the sides in a medial position between the ends. Each side defines nubbin and indentation structures to aid positional maintenance of a stacked array of a plurality of racks. Each end in its outwardly facing edge defines a plurality of spaced grooves to separate and positionally maintain adjacent coils of stored cord and each end defines at least one keyhole like slot to positionally maintain one end portion of a stored cord. The medial portion of each side defines two paired opposed notches to define therebetween a handle structure to aid grasping and manual manipulation of the rack by a user. All rack elements are configured for formation by injection molding from plastic material.

In creating such a device:

A principal object of my invention is to create a new and improved cord storage rack of flat configuration for the storage and positional maintenance of complex cord structures, especially such cords that are of a length such as may be stored in a single layer of coils upon the holder.

It is a further object to provide such a cord rack that has structural configuration to allow formation by molding resinous or polymeric plastics.

A further object is to provide such a rack that has only partially defined surfaces of a framework-like nature to support stored cord, but yet aids in preventing the entanglement of portions of complex cord structures.

A still further object is to provide such a cord storage rack that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement, with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 1 is an orthographic top view of my storage rack showing its various elements, their configuration and relationship.

FIG. 2 is an orthographic right side view of the rack of FIG. 1.

FIG. 3 is a traverse vertical cross-sectional view of the rack FIG. 1, taken on the line 3—3 in the direction indicated by the arrows thereon.

DESCRIPTION OF THE PREFERRED EMBODIMENT

Figure 4:
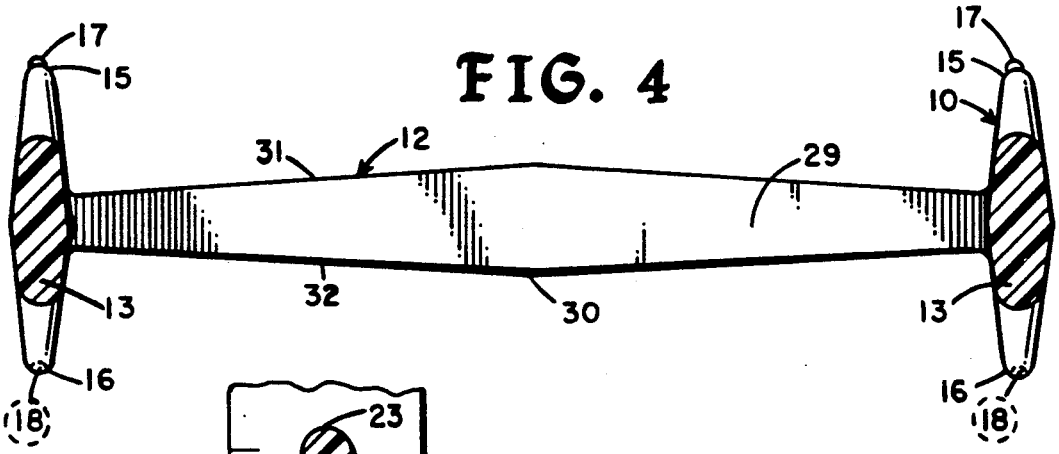
FIG. 4 is a medial traverse vertical cross-sectional view through the rack FIG. 1, taken on the line 4—4 in the direction indicated by the arrows thereon.

My invention in general provides similar flat sides 10 interconnected in spaced adjacency inwardly of their end portions by ends 11 and joined in their medial portions by medial support 12.

Sides 10 provide similar elongate body elements 13 having a height, perpendicular to their longer dimensions, of approximately 1/6th of that longer dimension and a thickness sufficient to provide appropriate strength and rigidity required of them. Each end 14 of the body elements is rounded as indicated to remove any sharp edges. The upper edges 15 and lower edges 16 of the side body are rounded to prevent structural cracking and damage to stored cords and to aid molding formation. Upper edge 15 of body element 13 defines protruding nubbins 17, and lower edge 16 defines complementarily arrayed indentations 18 to receive protuberances 17 similarly defined on another rack to aid in maintaining a plurality of storage racks in stacked array. The medial portion of body elements 13 define similar opposed handle notches 19 extending inwardly from sides 15 and 16 to define handle 20, preferably with side surfaces 21 formed in a crenate fashion as illustrated to aid manual gripping. The crenate shape of the handle edges is most effective if the indentations are somewhat the same size as the fingers of an average user of the device.

Figure 6:
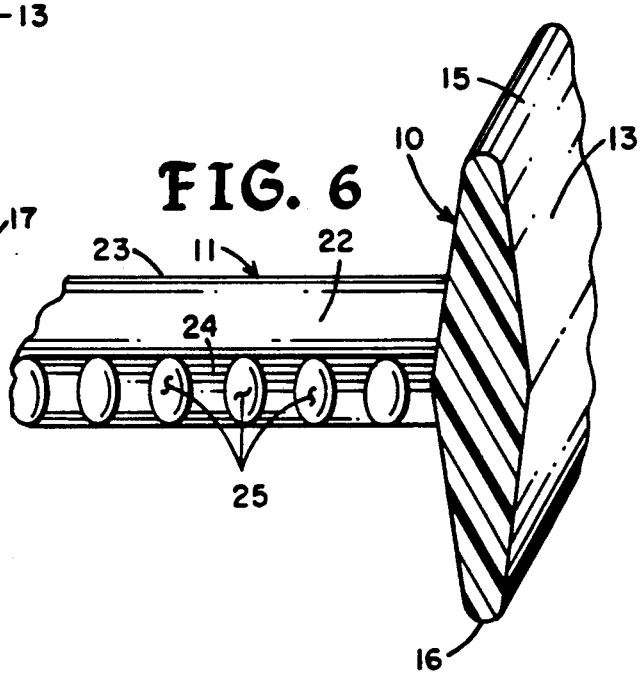
FIG. 6 is a somewhat enlarged, isometric view of one end portion of the cross-sectional view of FIG. 3, showing in somewhat better detail the three-dimensional shape of the side and end structures and their joinder.

The cross-sectional shape of body element 13 is symmetrical and tapers inwardly toward edges 15, 16 from a thickest medial portion, as shown especially in FIG. 6, to form a shape that may be readily molded in a two-piece injection mold. Similarly, protuberances 17 and indentations 18 are each of substantially hemispherical shape and positioned in the smaller outer edges of body element 13, again to allow formation in traditional molding processes.

Figure 5:
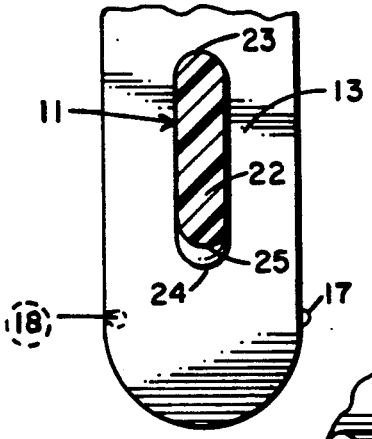
FIG. 5 is a vertical cross-sectional view through one end element of the rack of FIG. 1, taken on the line 5—5 thereon in the direction indicated by the arrows.

Ends 11 comprise similar elongate flat strips 22 having a width between inner edge 23 and outer edge 24 that is approximately 1/6th of the longer dimension of the strips. The thickness of each end strip is sufficient to provide appropriate cord support and necessary strength and rigidity for the rack. Both inner edge 23 and outer edge 24 are rounded, as shown especially in FIG. 5, to avoid any sharp edges that may damage cords wound thereabout and to provide surfaces adapted to a molding type formation process and formation from polymeric materials.

Each outer edge 24 of the end elements defines a plurality of spaced cord indentations 25 to receive and aid positional maintenance of cord coils wrapped sequentially about both end members. Cord indentations 25 in both end members are similar and preferably similarly spaced to receive an equal number of coils of cord and to aid in maintaining those coils in ordered array. The exact size and shape of the cord indentations is not critical. Preferably the indentations are formed similarly to the configuration illustrated with a somewhat half circular cross-section. The edges preferably are rounded to avoid damage to cords carried therein and thereabout. The diametrical size of the cord indentations should be at least as large as the diameter of cords to be carried therein for the indentations to best fulfill their purpose. Spacing distance between cord indentations is not critical, but should not be too great to allow carriage and storing of a maximum amount of cord on a storage rack while yet maintaining such spacing as well as minimize any potentiality for enlargements. Such spacing between indentations usually is not substantially greater than the diameter of the cord indentations.

Each end strip defines at least one keyhole type fastening slot providing narrower entry channel 26 extending inwardly from one side edge of an end strip to communicate with larger holding channel 27, generally of somewhat circular configuration. Entry channel 26 must be of sufficient size to allow the passage of the body of a cord to be held, and normally holding channels 27 should not be too much larger so as to provide efficient cord holding. These keyhole type holding channels may be defined to extend inwardly into the end strips from either the inner or outer sides and normally are most convenient if positioned inwardly adjacent the end portions of the end strips, somewhat as illustrated. A medial support notch 28 is defined in the middle portion of the inner side of each end strip to aid in supporting the storage rack on a small rod-like structure, such as a nail or the like. Since the rack is substantially symmetrical about a medial line extending through the holding indentations, it will be suspended in substantially vertical orientation by reason of gravity, if it be supported on a rod carried in support notch 28. Even when the rack carries stored cord, that cord will generally be substantially symmetrically disturbed to maintain somewhat the same positional orientation.

Each end strip is structurally carried between the two spaced opposed side elements in a vertically medial position betweem the edges 15, 16 and spacedly inwardly from the side strip ends. End and side elements are structurally joined at their communications by known means, or the entire rack is formed as a unitary structure to alleviate the necessity for any type of mechanical joinder.

Medial support 12 provides elongate flat support body 29 extending between the medial portions defined in handles 20 of the side elements. The medial portion 30 of body 29 is somewhat deeper than the end portions to provide greater spacing between layers of cord coiled on the storage rack in the medial part than along its edges. The thickness of the medial support, that is its dimension perpendicular to the longer dimension of the sides and to the depth, is not critical, but normally is about the same as the thickness of end strips 22. Upper edge 31 and lower 32 of the medial support body are rounded to prevent cord damage that might be caused by sharp edges. The end portions of the support body are structurally joined to the adjacent surfaces of body side elements 13 by known joinder means, or preferably by forming the entire rack in a unitary fashion.

My cord storage rack is preferably formed as a unitary structure from moldable polymeric or resinous plastic materials of appropriate strength, durability and rigidity. The entire structure is suited to injection molding in a two-piece mold according to known principles of the molding arts. Sharp corners, are eliminated, external edges are rounded, internal corners are filled by fillets 33, and no portion of the structure provides any undercut areas. The rounded external corners and the filleted surfaces at internal intersections provide additional strength and rigidity for a molded plastic structure and tend to aid in preventing cracking, chipping and similar problems sometimes associated with plastic edges, while at the same time providing a structure that does not damage cords stored thereon.

Having described the structure of my invention, its use may be understood.

A storage rack is formed according to the foregoing specifications. The dimensioning is not critical to my invention, but for most storage purposes of shorter lenghts of flexible cord having complex structure, such as Christmas tree lights and the like, a rack of approximately ten inch width between the two parallel sides, and approximately twenty-one inch length along a side is most convenient of use. Such a rack preferably provides cord indentations of approximately 0.25 inch diameter which, with the rack sizes specified, will allow storage of a cord of a length of over one hundred feet.

To store a cord in my rack, the cord, immediately inwardly adjacent one end, is moved through entry channel 28 of one of the keyhole slots 26 and into associated holding channel 27. The cord is then wrapped about ends 11 in uniform fashion with successive coils of cord being positioned in adjacent cord indentations 25. In wrapping the cord, the rack may be conveniently grasped by one or both handles 20 defined in either side element, and the cord may be wrapped around the rack or, if desired, the rack may be rotated relative to the cord to cause the wrapping action. After the cord is appropriately wrapped in this fashion, the second end portion of the cord is inserted in another keyhole type slot defined in the device to secure the cord for positional maintenance during storage. The cord is removed by reversal of the process described.

Figure 7:
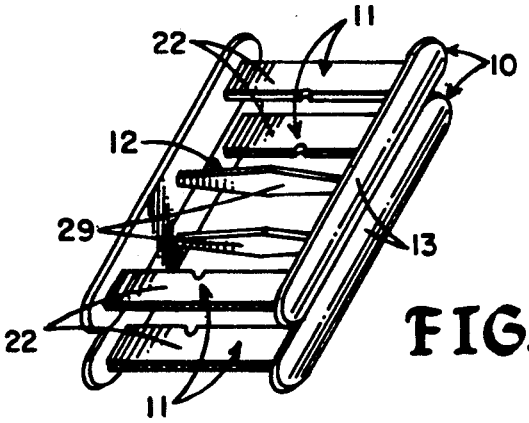
FIG. 7 is an isometric view, somewhat diagrammatically simplified, showing the stacking of two of the holders of my invention in vertical array.

A plurality of storage racks of the nature described, either with or without stored cord, may be stacked in vertical array as illustrated in FIG. 7, with the protuberances of one member fitting complementarily into the indentations of an adjacent member to aid in positionally maintaining the stacked array. It is to be noted that the sizing and configuration of the rack will generally prevent interference of adjacent coils of properly wrapped stored cords when my racks holding them are vertically adjacent.

It is to be particularly noted from the structure described that the coils of cord on one side of my rack will be separated in their medial portion from the coils on the other side by medial support 12, and that that medial support may have varied depth to aid the separation. With complex cords having dropper structures or other associated elements fastened to them, this type of separation is particularly important as without it, the dropper or other ancillary structure may become entangled with other similar structures and with other cord strands that are on the same side or on the opposite side of the rack. This feature makes my storage rack particularly well adapted for srorage of Christmas tree lights, fish lines with dropper attachments and other complex cord structures of similar nature, though use of my rack is not limited to such structures and the rack serves admirably for the storage of ordinary elongate flexible cord-like element of a simple nature.

It should further be noted that though my rack is designed primarily as a storage structure for flexible cords, it well may also serve as a merchandising device for such cords. A cord generally is positionally maintained on my rack by reason of the rack structure itself, when used as hereinbefore described. This type of cord maintenance may be enhanced, and the entire cord and storage rack structure packaged for merchandising, by means of so called "shrink wrap" plastic film or similar material which may cover the external surface of both rack and stored cord. The particular shape of the cord rack is well adapted for this use because overall the rack is substantially rectilinear and occupies a relatively small volume for the amount of cord stored upon its surface.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A relatively flat rack for storage of elongate flexible cord-like elements comprising, in combination:

similar paired opposed sides each formed by an elongate flat body element having rounded ends, a thicker elongate medial portion and a thinner edge portion, and defining two opposed medial notches extending inwardly a spaced distance from the body edges to define medial handles of crenate configuration in each side to aid manual manipulation of the rack, each said side defining on a first elongate edge inwardly adjacent each end a protuberance and on the second opposite elongate edge inwardly adjacent each end complementary indentations to receive protuberances of an adjacent rack to aid vertical stacking and positional maintenance of a plurality of similar racks;

similar opposed flat elongate ends structurally carried between the opposed rounded ends of the sides, each said end defining on its outer edge most distal from the other end a plurality of spaced cord indentations to receive a flexible cord-like element wrapped about both ends, at least one keyhole slot to releasably maintain the end portion of a cord and a support slot in a medial position on the edge proximal to the opposed end; and a medial support extending in structural communication between the opposed medial portions of the handle of each side element, said medial support having a wider medial portion and narrower end portions proximal each rack side.

* * * * *